US010398221B2

(12) United States Patent
Zünkeler

(10) Patent No.: US 10,398,221 B2
(45) Date of Patent: Sep. 3, 2019

(54) MULTI-POSITION TABLE

(71) Applicant: Benjamin Zünkeler, St. Louis, MO (US)

(72) Inventor: Benjamin Zünkeler, St. Louis, MO (US)

( * ) Notice: Subject to any disclaimer, the term of this patent is extended or adjusted under 35 U.S.C. 154(b) by 0 days.

(21) Appl. No.: 15/811,656

(22) Filed: Nov. 13, 2017

(65) Prior Publication Data

US 2019/0142153 A1 May 16, 2019

(51) Int. Cl.
*A47B 3/00* (2006.01)
*A47B 3/08* (2006.01)

(52) U.S. Cl.
CPC .... *A47B 3/0815* (2013.01); *A47B 2200/0042* (2013.01)

(58) Field of Classification Search
CPC ..... A47B 3/0815; A47B 2200/0042; A47B 3/0803; A47B 2200/0025; A47B 2003/08; A47B 13/08; A47B 13/04; A47G 13/08; A47G 13/04; A47G 7/04
USPC ..... 108/1, 6–8, 12, 13, 115, 59
See application file for complete search history.

(56) References Cited

U.S. PATENT DOCUMENTS 829,457 A * 8/1906 Briggs
881,278 A * 3/1908 Acheson
D157,381 S 2/1950 Kramer
2,539,700 A 1/1951 Pieper
2,576,287 A * 11/1951 English ..... A47B 3/0803 108/115
3,199,825 A * 8/1965 Bellows ..... A47B 3/0803 108/130
3,292,972 A * 12/1966 Krueger ..... A47C 7/70 297/162

(Continued)

FOREIGN PATENT DOCUMENTS

CN 205285506 U 6/2016
DE 19501567 * 5/1996

(Continued)

OTHER PUBLICATIONS

Written Opinion of the International Searching Authority (Federal Institute of Industrial Property of Moscow) in related patent application PCT/US2018/060570 and dated May 7, 2019.

*Primary Examiner* — Janet M Wilkens
(74) *Attorney, Agent, or Firm* — Hassan Abbas Shakir; Shakir Law PLLC

(57) ABSTRACT

A multi-position table includes a substructure for resting on a base, a superstructure pivotable between a first table position for use while sitting and a second table position for use while standing. The superstructure includes a first support associated with the first table position, the first support having a first top surface spaced a first distance from the base when the superstructure is in the first table position; a second support associated with the second table position, the second support having a second top surface spaced a second distance from the base when the superstructure is in the second table position, the second distance being different that the first distance. The table includes a locking member for locking a first and a second adjusting element together to prevent unintended movement from the first table position to the second table position or from the second table position to the first table position.

20 Claims, 7 Drawing Sheets

(56) References Cited

U.S. PATENT DOCUMENTS

| | | | | |
|---|---|---|---|---|
| 3,557,791 | A * | 1/1971 | Duffy | A61B 90/60 108/5 |
| 4,154,173 | A | 5/1979 | Chesnut | |
| 4,180,002 | A | 12/1979 | Huempfner | |
| D273,741 | S | 5/1984 | Kove | |
| D275,353 | S | 9/1984 | Dunbar | |
| D382,735 | S | 8/1997 | Zapf | |
| 6,164,211 | A * | 12/2000 | Fads | A47B 85/06 108/11 |
| 7,293,786 | B2 | 11/2007 | Burton et al. | |
| D613,526 | S | 4/2010 | Priestman | |
| 8,707,521 | B1 * | 4/2014 | Mack | E05D 11/06 16/326 |
| D764,847 | S | 8/2016 | Strater | |
| D817,651 | S | 5/2018 | Siebert et al. | |
| 10,051,960 | B1 * | 8/2018 | Siebert | A47B 85/04 |
| 2002/0117091 | A1 * | 8/2002 | Stem | A47B 1/04 108/13 |
| 2009/0283021 | A1 * | 11/2009 | Wong | B23K 37/0461 108/116 |
| 2013/0284077 | A1 | 10/2013 | Copeland et al. | |

FOREIGN PATENT DOCUMENTS

| | | | |
|---|---|---|---|
| RU | 2129829 | C1 | 5/1999 |
| RU | 98095 | U | 10/2010 |

* cited by examiner

MULTI-POSITION TABLE

BACKGROUND OF THE INVENTION

1. Field of the Invention

The invention is related to tables having multiple tabletop positions. Specifically, the invention is related to a multi-position table adaptable for use while sitting and for use while standing.

2. Discussion of the Related Art

Tables that are designed for seated use have a tabletop surface that is generally spaced 30 inches from the base, i.e., a ground or floor surface, on which the table rests. Such tables are commonly used for dining or work and have a tabletop that is more expansive than a tabletop used for tables used while standing.

Standing-use tables are commonly found in conference areas or breakrooms where one or more users each rest a beverage, but generally not much more, on the tabletop. The smaller tabletop of a standing-use table has a different position the tabletop seated-use table; it is generally spaced 42 inches from the base and provides a more intimate space allowing users to have a conversation over the noise of others.

However, often facilities require multiple types of tables, including for seated use and for standing use, which may differ only in the position of the tabletop. Increasing the different types of tables required increases the logistical issues of storage, delivery, change-over from one type to another, and/or removal. Thus, what is desired is a table that has multiple positions, i.e., is a multi-position table.

SUMMARY OF THE INVENTION

These and other objectives are met by one or more embodiments of the present invention.

In accordance with one or more embodiments of the present invention, a multi-position table adaptable for use while sitting and for use while standing includes a substructure for resting on a base; a superstructure pivotable between a first table position for use while sitting and a second table position for use while standing, the superstructure comprising a first support associated with the first table position, the first support comprising a first top surface, the first top surface spaced a first distance from the base when the superstructure is in the first table position; and a second support associated with the second table position, the second support comprising a second top surface, the second top surface spaced a second distance from the base when the superstructure is in the second table position, the second distance being different that the first distance; the first support being joined to the second support; an adjustor comprising a first adjusting element joined to the first support or the second support; a second adjusting element associated with the substructure; a locking member for user-selectably locking the first adjusting element and the second adjusting element together to prevent unintended movement from the first table position to the second table position or from the second table position to the first table position.

The multi-position table is characterized by the first adjusting element comprising a side member, the side member comprising a first setting member associated with the first table position and a second setting member with the second table position; and the locking member engaging the first setting member or the second setting member.

In accordance with one or more embodiments of the present invention, a table is adaptable for use while sitting and for use while standing. The table includes a superstructure, a substructure, and a pivoting element, the pivoting element for permitting the superstructure to pivot relative to the substructure to place the table in a first position for use while sitting from a use while standing and in a second position for use while standing; the superstructure having a first support and a second support, the first support joined to the first support at an edge of the first support, the first support and the second support defining therebetween a first angle; the substructure comprising a column for spacing the superstructure from a base; an adjustor comprising a first adjusting element associated with the superstructure, a second adjusting element associated with the column, and a locking member for engaging the first adjusting element and the second adjusting element; wherein the first adjusting element comprises a first receiver associated with the first support and a second receiver associated with the second support; wherein a second angle is defined between a first line from the first receiver to a cross-sectional center point of the pivoting element and a second line from the second receiver to the cross-sectional center point of the pivoting element; wherein the first angle and the second angle are equal.

BRIEF DESCRIPTION OF THE DRAWINGS

The invention may be understood by way of example and not limitation with respect the following drawing figures.

DETAILED DESCRIPTION OF THE INVENTION

Figure 1B:
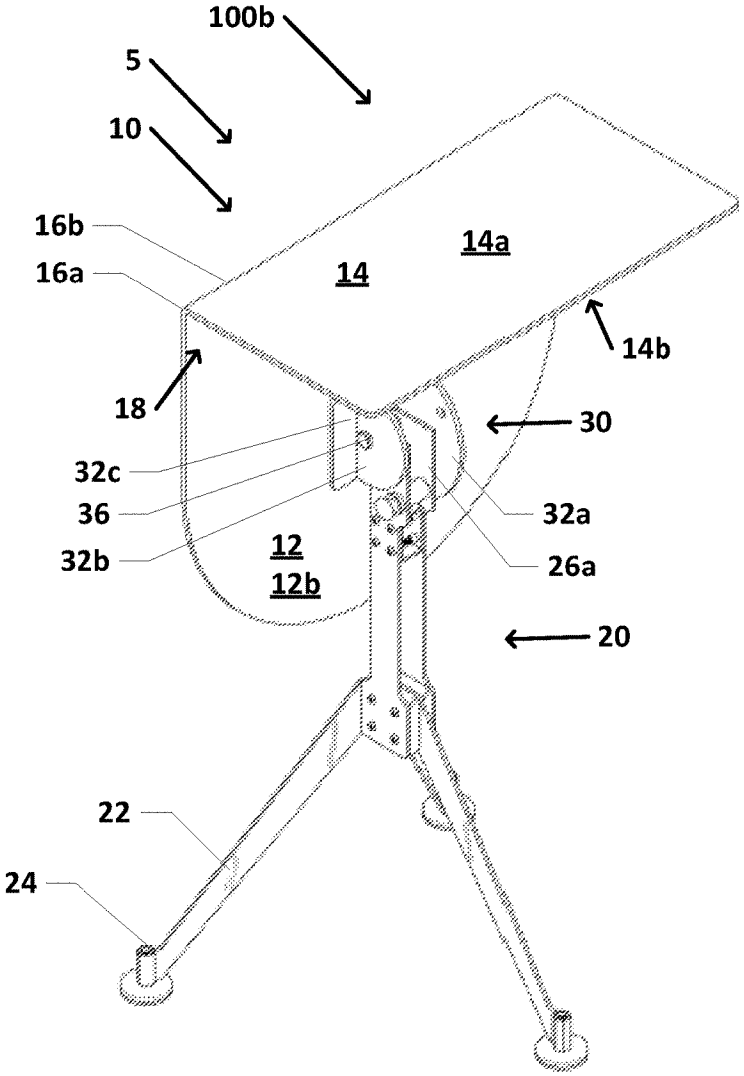
FIG. 1*b* is a perspective view of the multi-position table of FIG. 1*a* in a second table position in accordance with one embodiment of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

All technical and scientific terms shall have the same meaning as commonly understood by one of ordinary skill in the art. Nonetheless, certain terms are defined herein to aid in the understanding of the disclosure; these definitions apply to all parts of speech of the term regardless whether the term is defined explicitly as such.

Figure 1A:
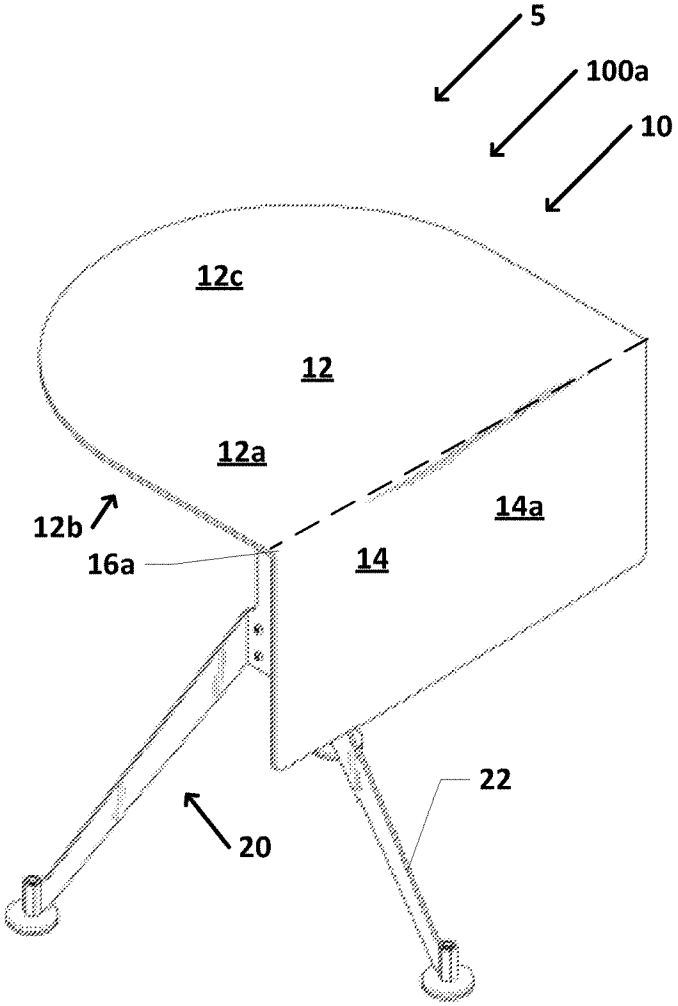
FIG. 1*a* is a perspective view of a multi-position table in a first table position in accordance with one embodiment of the present invention.

FIG. 1*a* is a perspective view of a multi-position table in a first table position in accordance with one embodiment of the present invention.

FIG. 1*b* is a perspective view of the multi-position table of FIG. 1*a* in a second table position in accordance with one embodiment of the present invention.

Figure 1C:
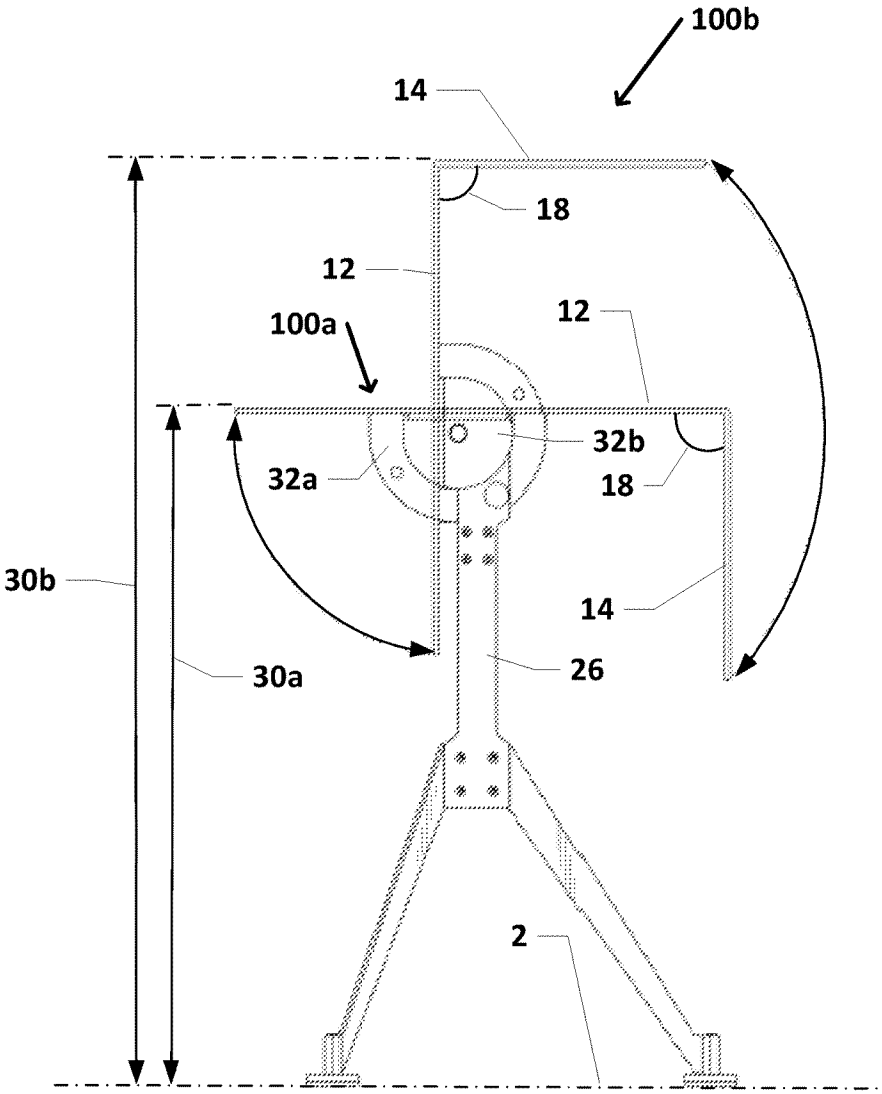
FIG. 1*c* is a side view of the multi-position table of FIGS. 1*a* and 1*b* illustrating the first and second table positions.

FIG. 1*c* is a side view of the multi-position table of FIGS. 1*a* and 1*b* illustrating the first and second table positions.

Figure 1F:
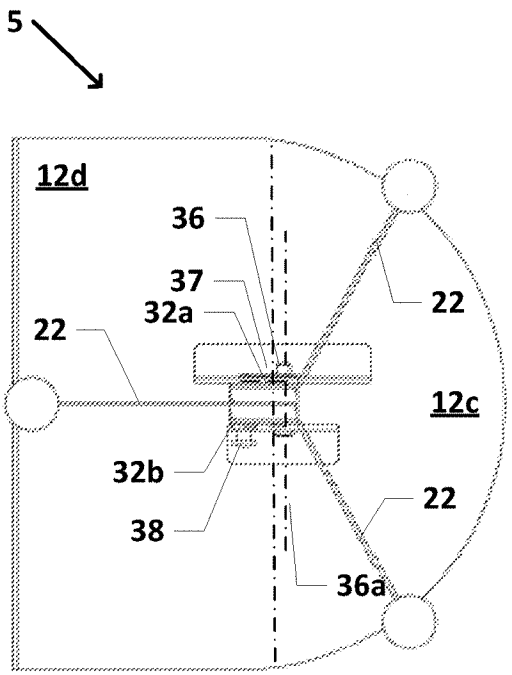
FIG. 1*f* is a view from the bottom of the multi-position table of FIG. 1*a* in a first table position in accordance with one embodiment of the present invention.
Figure 1E:
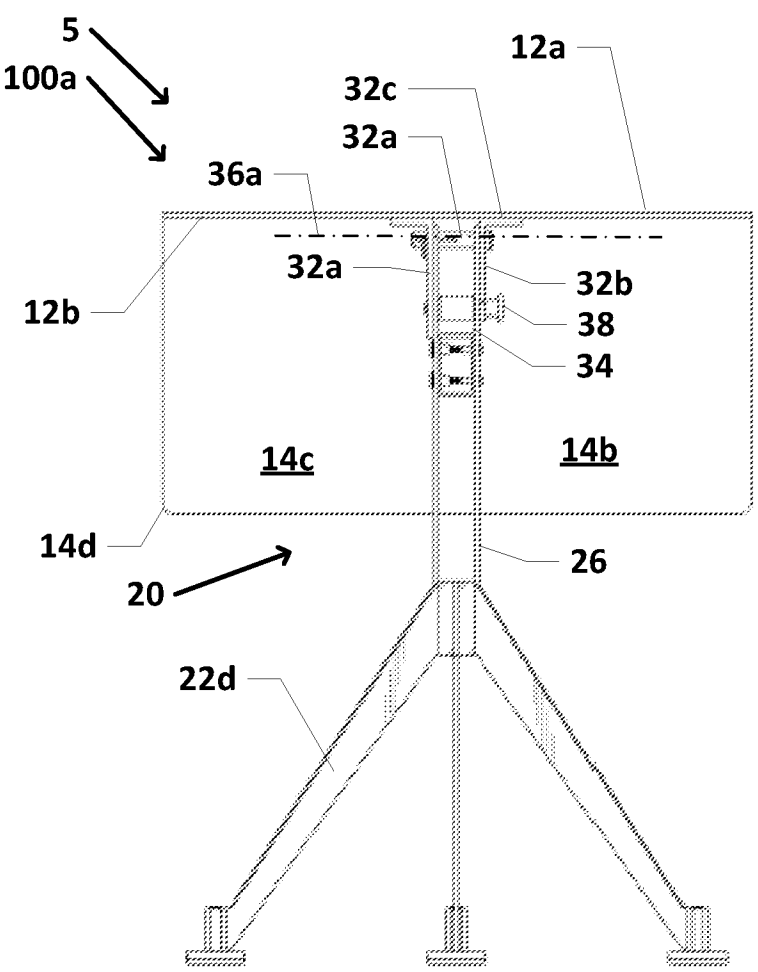
FIG. 1*e* is a rear view of the multi-position table of FIG. 1*a* in a first table position in accordance with one embodiment of the present invention.
Figure 1D:
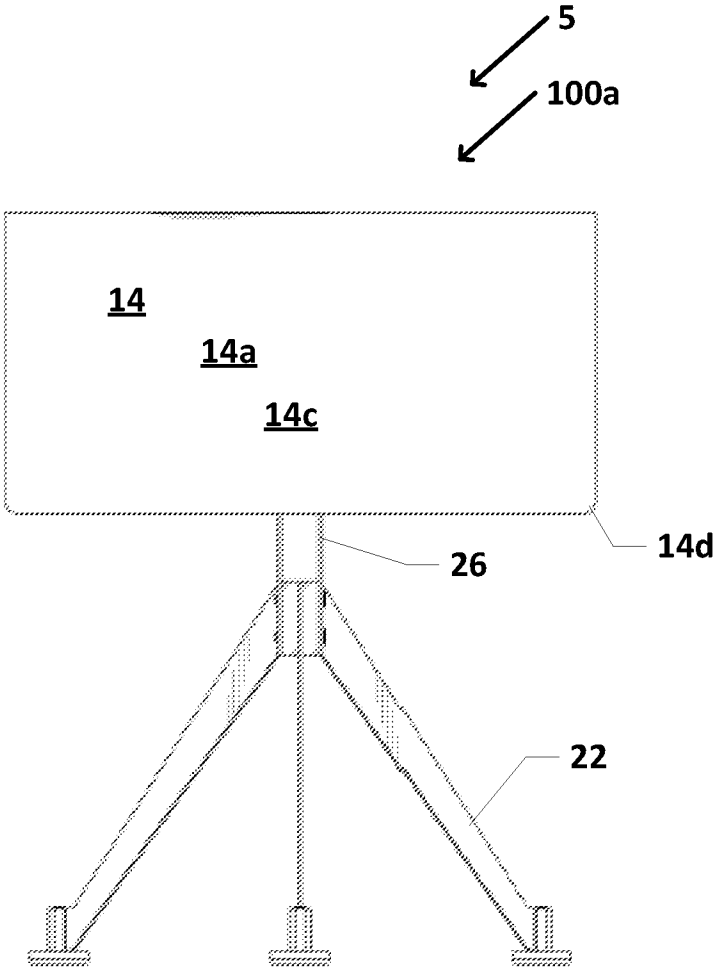
FIG. 1*d* is a front view of the multi-position table of FIG. 1*a* in a first table position in accordance with one embodiment of the present invention.

FIG. 1*d* is a front view of the multi-position table of FIG. 1*a* in a first table position in accordance with one embodiment of the present invention.

FIG. 1*e* is a rear view of the multi-position table of FIG. 1*a* in a first table position in accordance with one embodiment of the present invention.

FIG. 1*f* is a view from the bottom of the multi-position table of FIG. 1*a* in a first table position in accordance with one embodiment of the present invention.

Figure 1H:
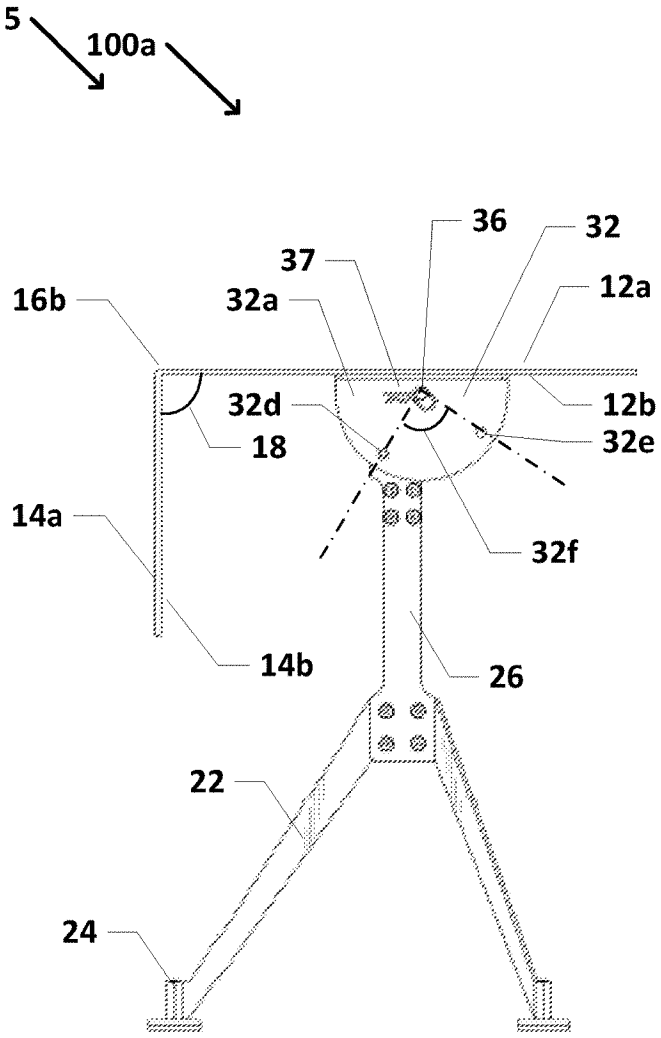
FIG. 1H is a right-side view of the multi-position table of FIG. 1A in a first table position in accordance with one embodiment of the present invention.
Figure 1G:
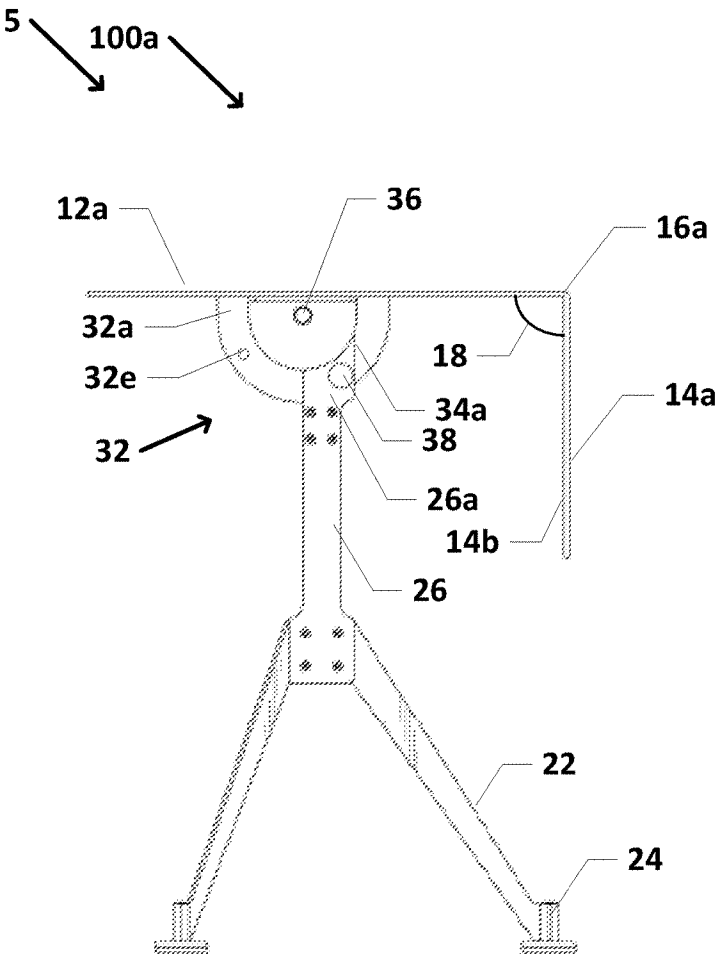
FIG. 1*g* is a left side view of the multi-position table of FIG. 1*a* in a first table position in accordance with one embodiment of the present invention.

FIG. 1*g* is a left side view of the multi-position table of FIG. 1*a* in a first table position in accordance with one embodiment of the present invention.

FIG. 1*h* is a right-side view of the multi-position table of FIG. 1*a* in a first table position in accordance with one embodiment of the present invention.

In accordance with one or more embodiments of the present invention, a multi-position table 5 is adjustable to have a support surface, i.e., tabletop, at different heights. Therein, table 5 does not rely on a hydraulic or gas shock absorber or hydraulic or gas lifter, which disadvantageously may fail or unintentionally accelerate.

In accordance with one or more embodiments of the present invention, table 5 is adaptable for use while sitting and while standing by moving a superstructure 10 between a first table position 100*a* for use while sitting and a second table position 100*b* for use while standing.

Table 5, preferably, comprises superstructure 10 for permitting a user to comfortably use table 5 while seated in a chair and while standing. Table 5 further comprises a substructure 20 for structural support of table 5 and to space superstructure 10 from a base 2 as well as an adjustor 30 for pivoting superstructure 10 relative to substructure 20.

Superstructure 10 may comprise a plurality of supports (for example, supports 12, 14) connected to each other. Each support comprises a support surface made of one or more durable materials arranged as a single layer or a plurality of layers. For example, one or more supports are made of aluminum.

Each support preferably is planar so that a user may place one or more items on the support, for example, for dining, work, storage, and/or display. Each support may be considered to be a tabletop and each support surface may be considered to be a tabletop surface. Preferably, each support meets another support at common end 16*a* and is offset from the other support by an angle 18, for example, angle 18 is preferably, but not limited, to a 90 degree angle. Where two supports meet, the two support surface form a common edge 16*b*.

In accordance with one or more embodiments of the present invention, each support surface may comprise a non-planar surface, an inclined surface, a smooth surface, a textured surface, one or more indentations, and/or any combination of two or more thereof.

Preferably, table 5 comprises a first support 12 and a second support 14 connected to each other at least at a common end 16*a* and offset by an angle 18. Therein, first support 12 comprises a first support surface 12*a* and an underside 12*b* that is preferably opposite to first support surface 12*a*. Second support 14 comprises a second support surface 14*a* and an underside 14*b* that is preferably opposite to second support surface 14*b*. Therein, angle 18 is (a) the angle between a plane defined by first support surface 12*a* and a plane defined by second support surface 14*a* or (b) is defined the angle between a plane defined by underside 12*b* and a plane defined by underside 14*b* as illustrated in the figures. Angle 18 according to definition (b) is preferably 90 degrees so that table 5 is compact as will be explained below.

First support 12 and/or second support 14 have any suitable regular or irregular geometric shape, but for reasons of compactness it is preferred that second support 14 is smaller than first support 12. Preferably, first support 12 comprises an arcuate-shaped edge defining an arcuate portion 12*c* and one or more linear edges defining between these edges a rectangular portion 12*d*. Preferably, second support 14 comprises a plurality of linear edges that define therebetween a substantially rectangular portion 14*c* that may include one or more rounded corners 14*d*. First support surface 12*a* and second support surface 14*a* meet at a common edge 16*b* of common end 16*a*.

In accordance with one or more embodiments of the present invention, substructure 20 rests on base 2, which may be any ground surface, floor, or flooring surface. Substructure 20 comprises one or more support legs 22 that are preferably splayed apart to provide stability to table 5 and also permit adjustment when base 2 is uneven or inclined. Therein, three support legs 22 are preferred for optimal stability, reduced weight, and ease of adjustment. A foot 24 is rotationally adjustable, i.e., adjustable to lengthen and/or shorten support leg 22, to the specific conditions of base 2 is disposed on a distal end of at least one support leg 22. Preferably, all support legs 22 have a foot 24 at a distal end of each of support leg 22.

Support legs 22 preferably meet at a support column 26 and may be fixed joined to support column 26. One or more support legs 22 may be angularly adjustable in one or more directions relative to one or more other support legs 22. Each support leg, preferably, is made of one or more durable materials arranged as a single layer or a plurality of layers. For example, one or more support legs are made of aluminum.

In accordance with one or more embodiments of the present invention, preferably table 5 comprises three support legs 22 to optimize stability while reducing overall weight. As shown in FIG. 1*f* a single support leg 22 is perpendicular with pivoting member 36 and under support 12 since the most force will be put on support 12. This arrangement further allows a user to get closer to table 5 when seated. The other two wide spread support legs 22 are located under support 14 to prevent side-to-side overturning.

Figure 4:
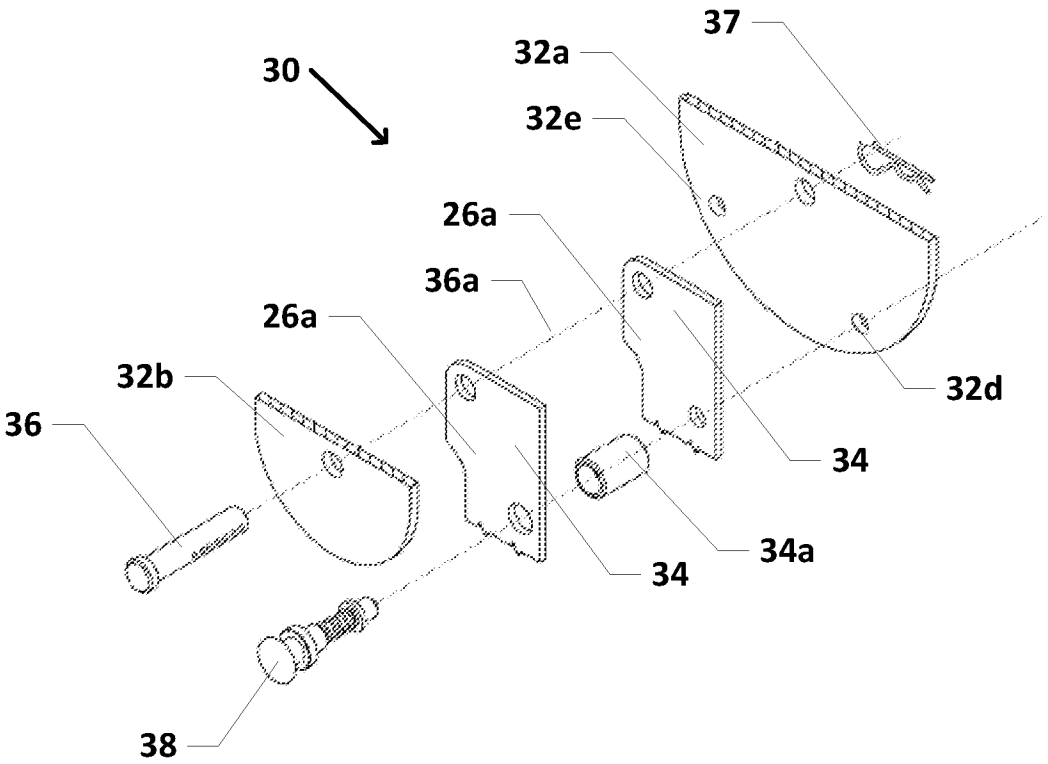
FIG. 4 is an exploded view of an adjustor of the multi-position table of FIG. 1*a*.

FIG. 4 is an exploded view of an adjustor of the multi-position table of FIG. 1*a*.

Adjustor 30 comprises a first adjusting element 32 and a second adjusting element 34. First adjusting element 32, preferably, may be joined to underside 12*b* of support 12 or in the alternative to underside 14*b* of support 14. First adjusting element 32 comprises one or more side members disposed adjacent to column 26. For example, first adjusting element 32 comprises a first side member 32*a* and a second side member 32*b* disposed on opposite sides of column 26 for stability. Second adjusting element 34 is preferably a portion of column 26 and may be embodied as one or more receiving elements, such as one or more openings that are preferably reinforced, one or more indentations, or one or more detents.

Adjustor 30 further comprises a pivotable pivoting member 36 for pivoting superstructure 10 relative to substructure 20 and a locking member 38 that locks the position of the first adjusting element 32 and second adjusting element 34 relative to each other. Pivoting member 36 may be embodied as a hinge or as a shaft.

Pivoting member 36 passes through side members 32*a* and 32*b* and support column 26 to pivot the superstructure 20 about a pivot axis 36*a*. That is, pivoting member 36 is seated in openings provided in side members 32*a* and 32*b* and support column 26 to pivot superstructure 10 from a first table position 100*a* to a second table position 100*b* about pivot axis 36*a*. Each opening maybe configured as a bearing having a bearing surface and or a ball bearing assembly. Pivoting member 36 and locking member 38 transfer the load of superstructure 10 and adjustor 30 to substructure 20, specifically, to support column 26.

To permit easy disassembly of table 5, one or more ends of pivoting member 36 may extend beyond an outer edge of side member 32*a* and/or side member 32*b* and may cooperate with one or more retainers 37 to permit removal of pivoting member 36 so that superstructure 10 and substructure 20 are separated. For example, pivoting member 36 has one or more holes into which a portion of retainer 37 in the form of a cotter pin is removably inserted. A spacer 34*a* may be disposed between two second adjusting element 34.

In accordance with one or more embodiments of the present invention, first adjusting element 32 comprises a side member 32*a* and a side member 32*b* that are parallel and fixedly joined directly or indirectly, for example via base plate 32*c*, to either support 12 or support 14. Preferably, side members 32*a* and 32*b* are fixed joined to base plate 32*c*.

Side member 32*a* and/or side member 32*b* comprises a first setting member 32*d* associated with first table position 100*a* and a second setting member 32*e* with second table position 100*b*. Preferably, setting members 32*d* and 32*e* are formed as openings in which locking member 38 is received. In a planar view of side member 32*a* and/or side member 32*b*, first setting member 32*d* and second setting member 32*e* are each located on a pivoting arc having a center point of pivoting member 36 when seen in cross-section of pivoting member 36, and separated by an angle 32*f*, which preferably is identical to angle 18.

Second adjusting element 34 comprises one or more column setting members 34*a* in column 26. For example, column 26 has an extended area 26*a* in each of pair of column sections in which column setting members 34*a* is provided, for example as an opening. Locking member 38 engages the one or more column setting members 34*a* and setting members 32*d* and 32*e* to retain table 5 in a user-selected table position 100*a* or 100*b*. Locking member 38 disengages from the one or more column setting members 34*a* and setting members 32*d* and 32*e* to change table 5 from a user-selected table position 100*a* to table position 100*b*.

In accordance with one or more embodiments of the present invention, the one or more column setting members 34*a* and/or setting members 32*d* and 32*e* are each configured as openings in which locking member 38 configured as a locking pin that a user slides into and out of the one or more column setting members 34*a* and/or setting members 32*d* and/or 32*e*.

In accordance with one or more embodiments of the present invention, side member 32*a* is sized so that locking member 38 does not pass through side member 32*a*; that is side member 32*a* is smaller than side member 32*b*. Further, locking member 38 is spring-biased against column 26, i.e., substructure 20, and arranged to be retained in column 26 when a user pulls locking member 38 out of the one or more column setting members 34*a* and one of setting members 32*d* or 32*e*. The spring-biasing arrangement prevents the user from having to completely disengage the locking member from table 5 and permits easier usage when switching the table from one table position to the other.

In accordance with one or more embodiments of the present invention, the pivoting element is spaced further from the base than the locking member.

Figure 2B:
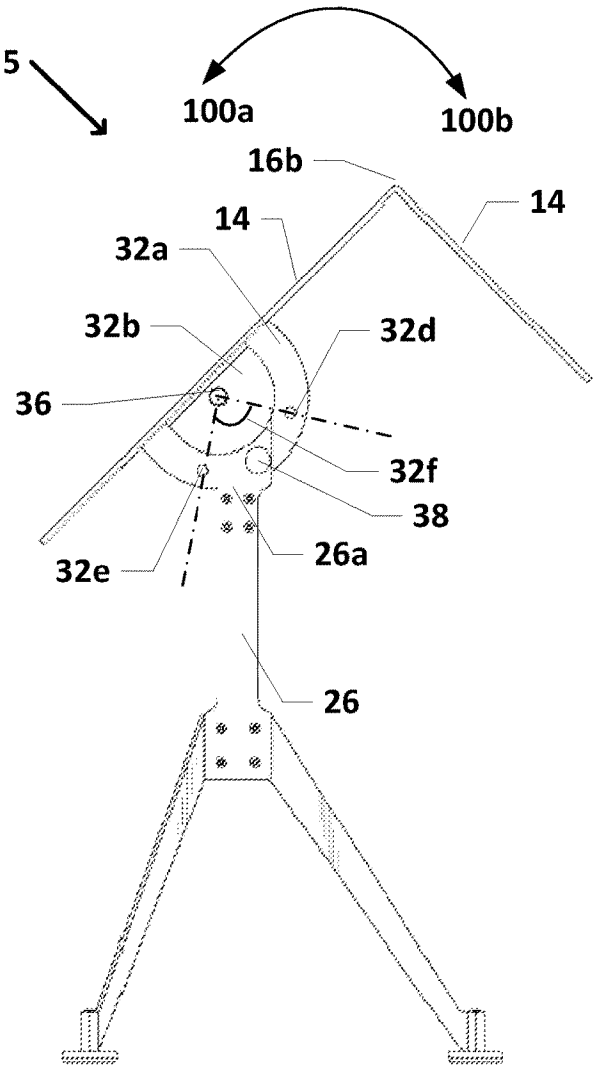
FIG. 2*b* is a left side view of the multi-position table of FIG. 12*a* while being moved from a first table position to a second table position in accordance with one embodiment of the present invention.
Figure 2A:
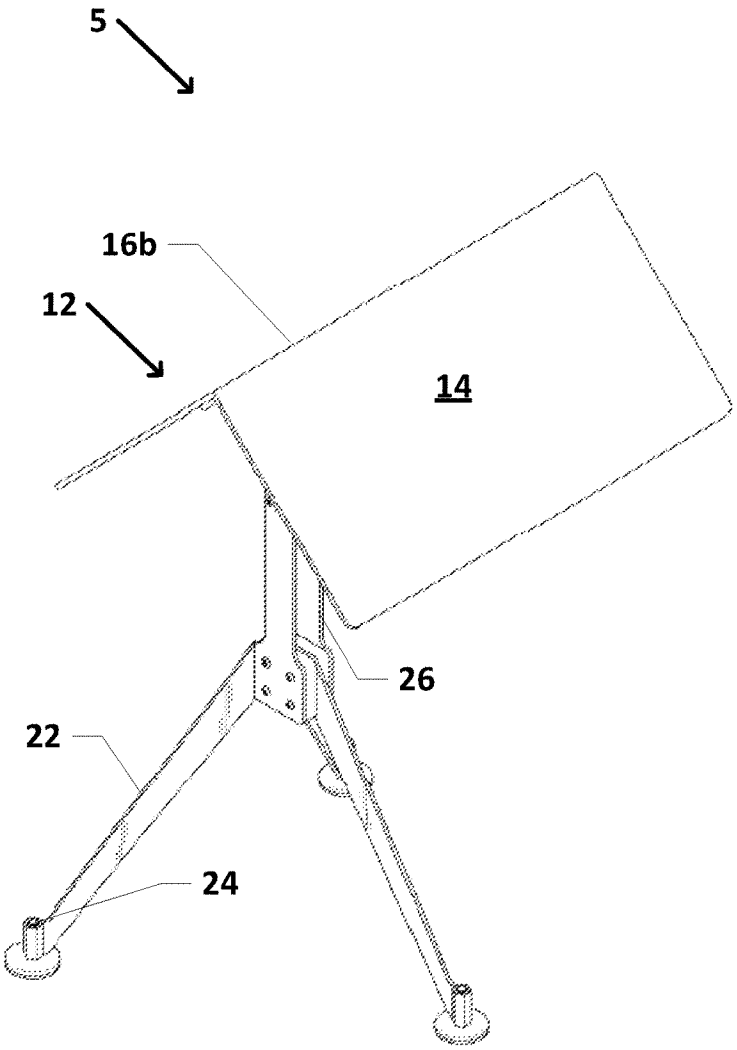
FIG. 2*a* is a perspective view of the multi-position table of FIG. 1*a* while being moved from a first table position to a second table position in accordance with one embodiment of the present invention.

FIG. 2*a* is a perspective view of the multi-position table of FIG. 1*a* while being moved from a first table position to a second table position in accordance with one embodiment of the present invention.

FIG. 2*b* is a left side view of the multi-position table of FIG. 12*a* while being moved from a first table position to a second table position in accordance with one embodiment of the present invention.

Figure 3B:
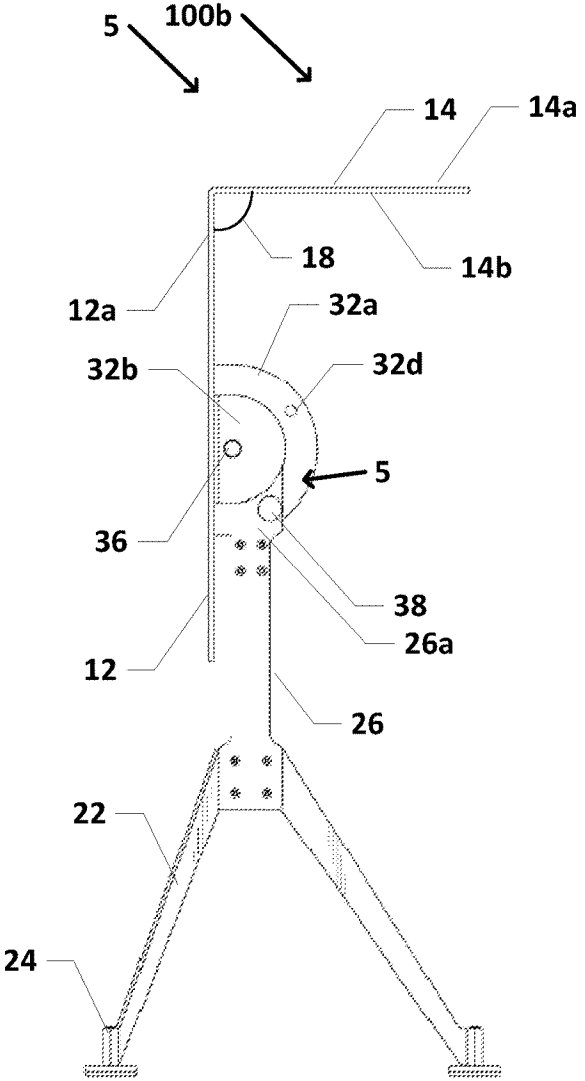
FIG. 3*b* is a left side view of the multi-position table of FIG. 1*a* in a second table position in accordance with one embodiment of the present invention.
Figure 3A:
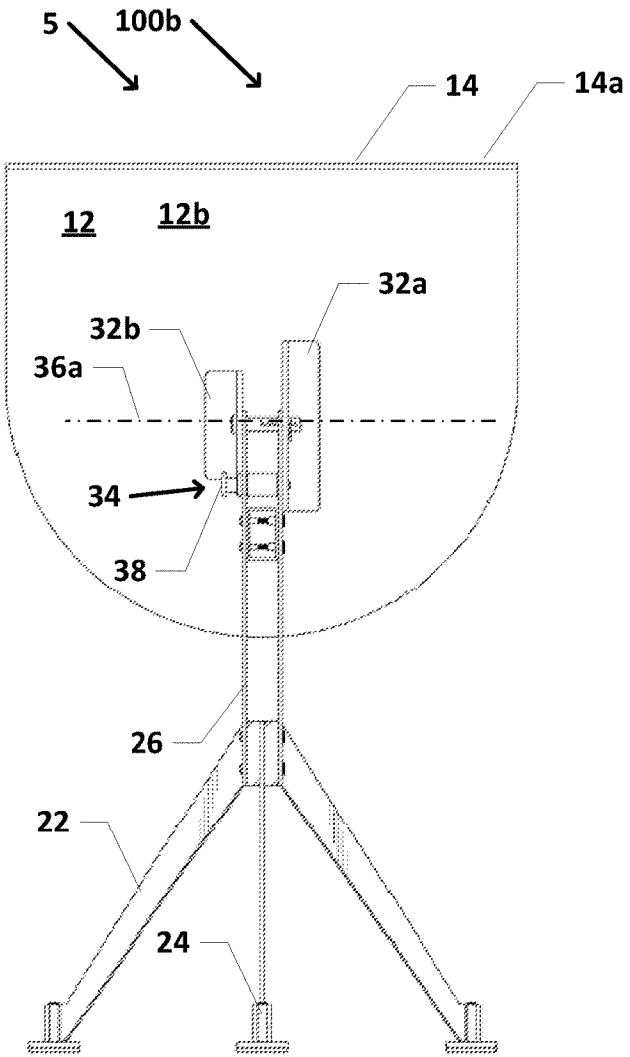
FIG. 3*a* is a front view of the multi-position table of FIG. 1*a* in a second table position in accordance with one embodiment of the present invention.

FIG. 3*a* is a front view of the multi-position table of FIG. 1*a* in a second table position in accordance with one embodiment of the present invention.

FIG. 3*b* is a left side view of the multi-position table of FIG. 1*a* in a second table position in accordance with one embodiment of the present invention.

In accordance with one or more embodiments of the present invention, first table position 100*a* and second table position 100*b* define two different heights for table 5 based on a position of the tabletop in relation to pivot axis 36*a*. In first table position 100*a*, first support surface 12*a* is spaced a first distance 30*a* is spaced 30 inches from base 2 and is, preferably, for seated work including video conference, note taking, or one-on-one meetings. In second table position 100*b*, second support surface 14*a* is spaced a second distance 30*b* is spaced 42 inches from base 2 and is, preferably, for standing note-taking, resting a drink while on the phone.

In accordance with one or more embodiments of the present invention, a user wishing to change table 5 from a first table position 100*a* to a table position 100*b* disengages locking member 38 from the one or more column setting members 34*a* and/or setting members 32*d* and 32*e* by pulling it out. The user then rotates superstructure 10 to place table in position 100*b* and engages locking member 38.

Therein, table 5 is a sit-to-stand solution that has a mechanical locking and release system (opposed to hydraulic or electric components). Adjustor 30 comprises a "pull-pin" locking mechanism that preferably is located as far as possible from the pivot point while not making it awkward to reach. Consequently, there is less play in superstructure 10 when it is in a fixed location (either high or low). The further from the pivot point the smaller the angle of possible travel of the pin in its locked position.

In accordance with one or more embodiments of the present invention, adjustor 30 may include a hinge similar to a hinge used in a reclining seat that allows the lever to be parallel to the hinge so that it would stick out underneath the lower table surface.

While the invention has been described in conjunction with specific embodiments, it is to be understood that many alternatives, modifications, and variations will be apparent to those skilled in the art in light of the foregoing description.

What is claimed is:

1. A multi-position table designed specifically for use while sitting and for use while standing; the table comprising:

a substructure for resting on a base;

a superstructure pivotable 90 degrees between a first table position for use while sitting and a second table position for use while standing, the superstructure comprising a first support associated with the first table position, the first support comprising a first top surface, the first top surface spaced a first distance from the base when the superstructure is in the first table position; and a second support associated with the second table position, the second support comprising a second top surface, the second top surface spaced a second distance from the base when the superstructure is in the second table position, the second distance being different that the first distance;

the first support being joined to the second support;

an adjustor comprising a first adjusting element joined to the first support or the second support;

a second adjusting element associated with the substructure;

a locking member for user-selectably locking the first adjusting element and the second adjusting element together to prevent unintended movement from the first table position to the second table position or from the second table position to the first table position.

2. The multi-position table of claim 1, wherein the first adjusting element comprises a side member, the side member comprising a first setting member associated with the first table position and a second setting member with the second table position; and wherein the locking member engages the first setting member or the second setting member.

3. The multi-position table of claim 1, wherein the first adjusting element comprises a side member, the side member comprising a first setting member associated with the first table position and a second setting member with the second table position;

wherein the second adjusting element comprises a column setting member; and wherein the locking member engages the column setting member and either the first setting member or the second setting member.

4. The multi-position table of claim 1, wherein the adjustor comprises a pivotable shaft for pivoting the superstructure, the pivotable shaft passing through a side member and the substructure, the pivotable shaft having a center point defining a center of a pivoting arc;

wherein the first adjusting element comprises a side member, the side member comprising a first setting member associated with the first table position and a second setting member with the second table position;

wherein the first setting member and the second setting member are disposed on the pivoting arc;

wherein the first setting member and the second setting member are separated on the pivoting arc by a first angle.

5. The multi-position table of claim 4, wherein a first plane disposed in the first support and a second plane disposed in the second support intersect at a second angle;

wherein the first angle and the second angle are identical.

6. The multi-position table of claim 1, wherein the first adjusting element comprises a first side member and a second side member;

wherein the adjustor comprises a pivotable shaft for pivoting the superstructure, the pivotable shaft passing through the first side member, the second side member, and the substructure.

7. The multi-position table of claim 6, wherein the first side member comprises a first setting member associated with the first table position and a second setting member with the second table position;

wherein the second adjusting element comprises a column setting member; and wherein the locking member engages the column setting member and either the first setting member or the second setting member.

8. The multi-position table of claim 1, wherein the first support is larger than the second support.

9. The multi-position table of claim 1, wherein the locking member is spring-biased against the substructure.

10. The multi-position table of claim 1, further comprising a plurality of support legs, wherein the plurality of support legs being splayed for stability.

11. The multi-position table of claim 6, further comprising a plurality of support legs, wherein at least one support leg of the plurality of support legs is oriented perpendicular with a pivoting member and disposed under the first support.

12. A table designed specifically for use while sitting and for use while standing; the table comprising:

a superstructure, a substructure, and a pivoting element, the pivoting element for permitting the superstructure to pivot relative to the substructure to place the table in a first position for use while sitting from a use while standing and in a second position for use while standing;

the superstructure having a first support and a second support, the first support joined to the first support at an edge of the first support, the first support and the second support defining therebetween a first angle;

the substructure comprising a column for spacing the superstructure from a base;

an adjustor comprising a first adjusting element associated with the superstructure, a second adjusting element associated with the column, and a spring-biased pull-pin locking member for engaging the first adjusting element and the second adjusting element;

wherein the first adjusting element comprises a first receiver associated with the first support and a second receiver associated with the second support;

wherein a second angle is defined between a first line from the first receiver to a cross-sectional center point of the pivoting element and a second line from the second receiver to the cross-sectional center point of the pivoting element;

wherein the first angle and the second angle are equal.

13. The table of claim 12, wherein the first adjusting element comprises a first side member and a second side member;

wherein the pivoting element passes through the first side member and the second side member, wherein the locking member does not pass through the first side member.

14. The table of claim 12, wherein the first adjusting element comprises a side member, the side member comprising a first setting member associated with the first table position and a second setting member with the second table position;

wherein the locking member is being received in the first setting member or the second setting member and the second adjusting element to prevent unintended pivoting of the substructure.

15. The table of claim 12, further comprising a column setting member disposed in the column for receiving the locking member.

16. The table of claim 12, wherein the pivoting element is spaced further from the base than the locking member.

17. A table designed specifically for use while sitting and for use while standing; the table comprising:

a superstructure, a substructure, and a pivoting element, the pivoting element for permitting the superstructure to pivot relative to the substructure to place the table in a first position for use while sitting from a use while standing and in a second position for use while standing;

the superstructure having a first support and a second support, the first support joined to the first support at an edge of the first support, the first support and the second support defining therebetween a first angle;

the substructure comprising a column for spacing the superstructure from a base;

an adjustor comprising a first adjusting element associated with the superstructure, a second adjusting element associated with the column, and a locking member for engaging the first adjusting element and the second adjusting element;

wherein the first adjusting element comprises a first receiver associated with the first support and a second receiver associated with the second support;

wherein a second angle is defined between a first line from the first receiver to a cross-sectional center point of the pivoting element and a second line from the second receiver to the cross-sectional center point of the pivoting element;

wherein the first angle and the second angle are equal;

wherein the first adjusting element comprises a first side member and a second side member;

wherein the pivoting element passes through the first side member and the second side member, wherein the locking member does not pass through the first side member.

18. The table of claim 17, wherein the side member comprises a first setting member associated with the first table position and a second setting member with the second table position;

wherein the locking member is being received in the first setting member or the second setting member and the second adjusting element to prevent unintended pivoting of the substructure.

19. The table of claim 1, wherein the locking member is a spring-biased pull-pin.

20. The table of claim 1, wherein when the first support is in the first table position, the second support has an edge closer to the base than the first support.

* * * * *